US007793578B1

(12) United States Patent
Lenoble et al.

(10) Patent No.: US 7,793,578 B1
(45) Date of Patent: Sep. 14, 2010

(54) PERCUSSION DEVICE FOR A MEDIUM OR LARGE CALIBRE WEAPON

(75) Inventors: Michel Lenoble, Bourges (FR); Michel Baubois, Bourges (FR)

(73) Assignee: CTA International, Bourges (FR)

( * ) Notice: Subject to any disclaimer, the term of this patent is extended or adjusted under 35 U.S.C. 154(b) by 731 days.

(21) Appl. No.: 11/699,453

(22) Filed: Jan. 30, 2007

(30) Foreign Application Priority Data

Jan. 30, 2006 (FR) ..... 06 00824

(51) Int. Cl.
*F41A 19/00* (2006.01)

(52) U.S. Cl. ..... 89/27.14; 89/27.11; 89/27.12; 89/28.1

(58) Field of Classification Search ..... 89/27.11, 89/27.12, 27.14, 28.1
See application file for complete search history.

(56) References Cited

U.S. PATENT DOCUMENTS 2,363,675 A * 11/1944 Johnson, Jr. ..... 42/105
4,879,827 A 11/1989 Gentry ..... 42/23
6,212,990 B1 * 4/2001 Elspass ..... 89/28.1
2003/0047063 A1 * 3/2003 Sullivan ..... 89/6.5

FOREIGN PATENT DOCUMENTS

CH 227369 6/1943
DE 644 764 5/1937

* cited by examiner

*Primary Examiner*—Stephen M Johnson
*Assistant Examiner*—Daniel J Troy
(74) *Attorney, Agent, or Firm*—Steptoe & Johnson LLP

(57) ABSTRACT

A percussion device for a medium or large caliber weapon incorporating a firing pin, spring means and a drive cam for the firing pin enabling its displacement in translation up to an "armed" position and the compression of the spring means, such device wherein it incorporates means to immobilize the firing in the "armed" position, these means being supported by the weapon breech and able to take up a position in which they immobilize the firing pin and another in which they release the firing pin.

9 Claims, 5 Drawing Sheets

PERCUSSION DEVICE FOR A MEDIUM OR LARGE CALIBRE WEAPON

BACKGROUND OF THE INVENTION

1. Field of the Invention

The technical scope of the present invention is that of medium and large caliber weapons, and more particularly ammunition percussion devices positioned in such weapons.

2. Description of the Related Art

The equipment of military vehicles necessitating the use of weapons integrated into a turret increasingly requires the use of a fire control able to ensure, at all times, the control in space of the position of the gun barrel, be the carrier at rest or in movement.

This constraint of having to ensure the firing of a turreted weapon with a carrier in movement, whilst retaining a high probability of reaching the target, obliges both the position of the barrel in space as a function of time and also the projectile launching time to be controlled.

Present-day weapon mechanisms generally carry out firing in two phases; a first phase in which the ammunition is pushed into position and triggered by pressing on the fire control and a second percussion phase of the ammunition triggered by a computer verifying that the gun barrel is aligned with the objective when the projectile exits the barrel.

The percussion of the ammunition implements a cam whose geometry firstly enables the compression of spring means and secondly the release of the firing pin.

A major drawback to these devices lies in the fact that the reaction time between the compression of the spring means and the exiting of the projectile from the barrel muzzle necessarily exceeds a few tenths of a second. This cycle time is not compatible with firing in movement which necessitates a time of a few hundredths of a second between the validation by the computer and the actual percussion of the ammunition.

SUMMARY OF THE INVENTION

The aim of the present invention is to supply an electromagnetic device aiming to overcome these problems.

The device thus relates to a percussion device for a medium or large caliber weapon incorporating a firing pin, spring means and a drive cam for the firing pin enabling the displacement in translation of the firing pin up to an "armed" position and the compression of the spring means, such device wherein it incorporates means to immobilize the firing in the "armed" position, these means being supported by the weapon breech and able to take up a position in which they immobilize the firing pin and another in which they release the firing pin.

According to one characteristic of the invention, the means to immobilize the firing pin in the "armed" position is a sear displaced by an actuator so as to release the firing pin.

According to another characteristic of the invention, the percussion device incorporates a tappet exerting a stress on the sear in a direction substantially opposing that of the actuator.

According to yet another characteristic of the invention, the sear incorporates a face to immobilize the firing pin, substantially orthogonal to the axis of displacement of the firing pin, to ensure the immobilization of the firing pin in the "armed" position, and a bearing face for the actuator, substantially orthogonal to the immobilizing face of the firing pin and to the axis of displacement of the actuator, the bearing face being subjected to the action of the actuator.

According to another characteristic of the invention, the sear is "L" shaped, a first branch of which, positioned orthogonally to the firing pin, ensures the immobilization of the firing pin in the "armed" position and a second branch, substantially perpendicular to the first one and to the actuator, is subjected to the action of the actuator.

According to another characteristic of the invention, the sear is supported by a pivot with a hinge pin orthogonal to the immobilizing face of the firing pin.

According to another characteristic of the invention, the sear incorporates a beveled face onto which the firing pin presses when being moved into its "armed" position enabling the bearing stress of the firing pin on the beveled face to be transformed into a pivoting of the sear around its pivot.

Lastly, the invention also relates to a firing process for a piece of ammunition implementing a percussion device according to the invention, wherein the rotation of the cam is triggered, by means of a first "firing cycle" command, so as to drive the firing pin in translation up to its "armed" position and compress spring means, and by means of a second "percussion" command, the displacement of the immobilizing means is triggered so as to release the firing pin which, under the action of the spring means, is displaced in translation and strikes the ammunition, thereby firing it.

According to one characteristic of the process, the percussion device incorporates cam position sensors and the "percussion" command is only delivered when the cam is in a percussion zone.

According to one characteristic of the process, the movement of the firing pin into the "armed" position and the compression of the spring means are performed simultaneously when the ammunition is pushed into position.

A first advantage of the device according to the invention lies in the reduction in time between the firing command and the firing of the ammunition.

Another advantage lies in the possibility of adapting the device to all types of medium or large caliber weapon.

Another advantage lies in the fact that the elements composing the device according to the invention may be controlled manually, thereby enabling the device to function even in the event of the failure or destruction of the vehicle's power source.

Another advantage lies in the fact that the device according to the invention integrated into a weapon with an advanced firing control prevents any firing "out-of-zone" since only the appearance of the percussion command linked to the coincidence between the laying of the gun and the line of sight authorizes the ammunition to be fired.

BRIEF DESCRIPTION OF THE DRAWINGS

Other characteristics, particulars and advantages of the invention will become apparent from the following description given by way of illustration and in reference to the appended drawings, in which.

DETAILED DESCRIPTION OF PREFERRED EMBODIMENTS

Figure 1:
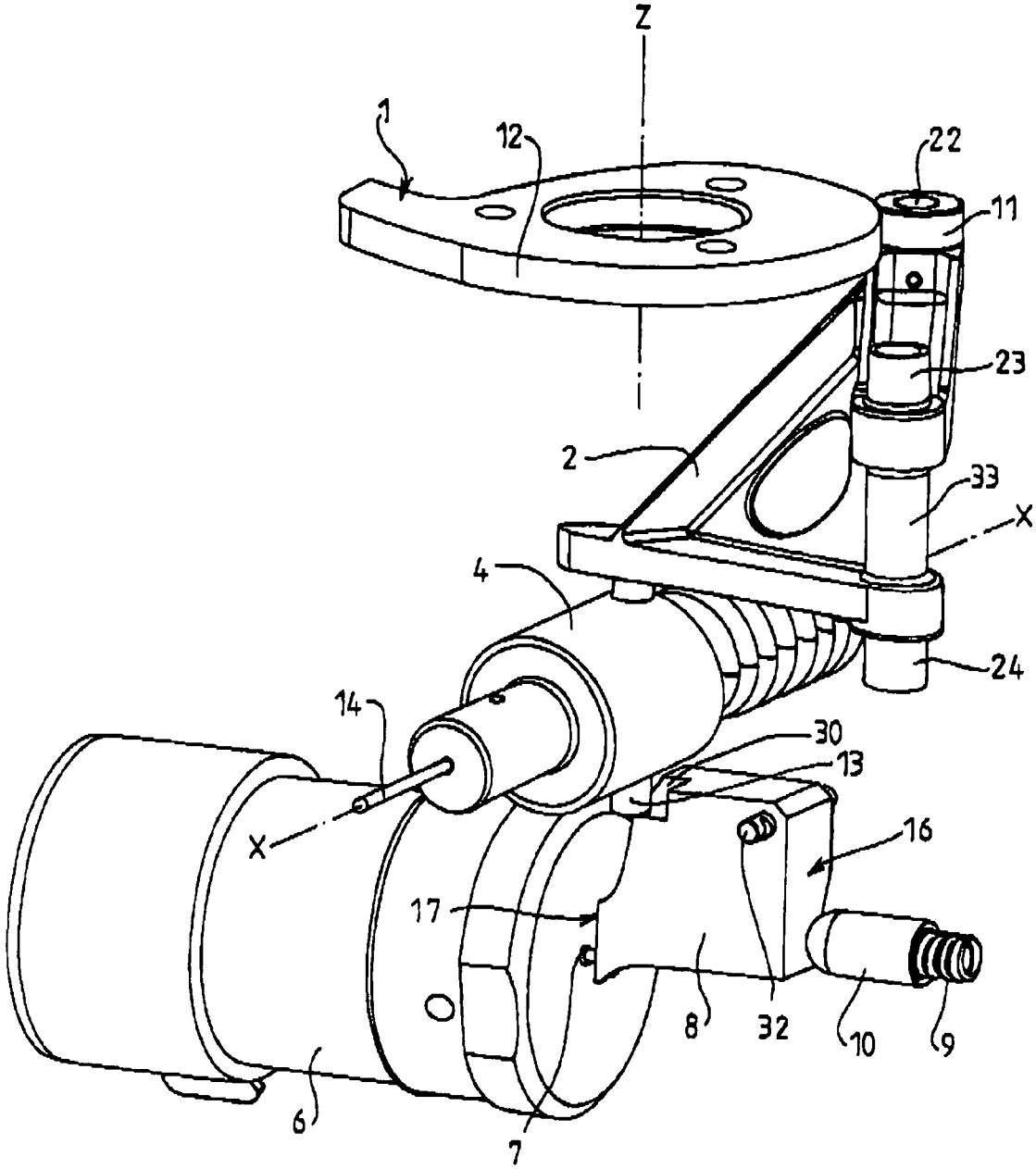
FIGS. 1 and 2 show a percussion device according to the invention, when being placed in its "armed" position.
Figure 2:
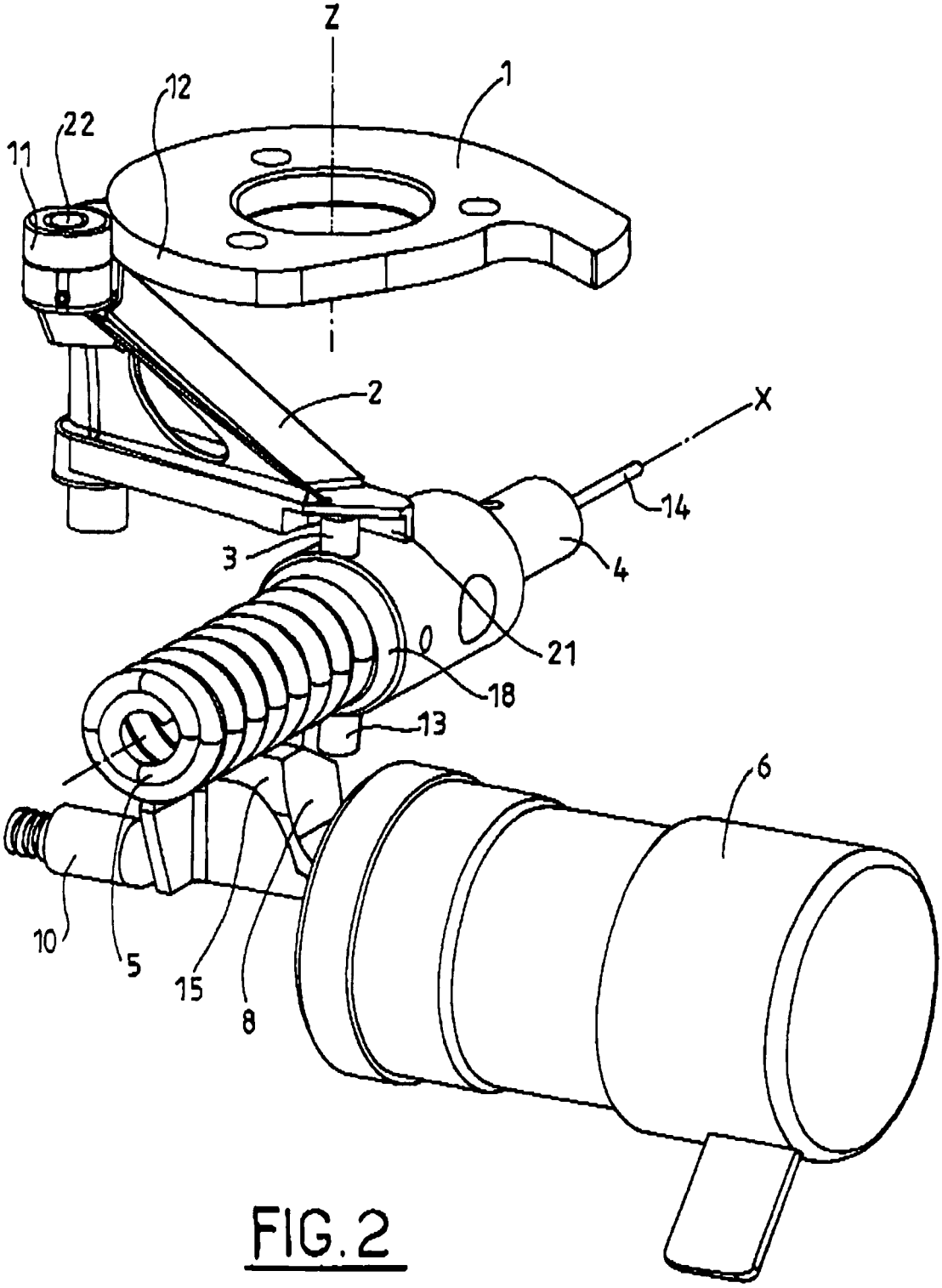

FIGS. 1 and 2 are respectively front and rear perspective views showing an example embodiment of the percussion device according to the invention, being placed in its "armed" position. For the sake of clarity, only those elements required for the comprehension of the invention have been shown. Certain elements, such as the drive means for the cam, the ammunition or the gun breech, are not shown but are already well known to someone skilled in the art and thus do not require any further description or specific representation.

The percussion device thus shown is a percussion device for a medium or large caliber weapon incorporating a cam 1, an arming lever 2, a firing pin 4, spring means 5, a sear 8, an actuator 6 and a tappet 10. This device is arranged in a classical manner in the breech of the weapon it equips.

The cam 1 is made in a known manner. It has a rotational movement around rotational axis Z and incorporates a lateral rolling surface 12 (which will not be further described) cooperating with the arming lever 2 so as to drive it in rotation.

The arming lever 2 incorporates a rotation shaft 33 whose ends 23 and 24 are supported by bore holes in the breech so as to form a pivot link with the breech. The arming lever 2 also incorporates a pin 22, that is off-centre with respect to the shaft 33, around which a roller 11 pivots that is intended to cooperate with the lateral rolling surface 12 of the cam 1. The arming lever lastly incorporates a groove 21 (FIG. 2) intended to cooperate with the firing pin 4.

The firing pin body 4 is substantially cylindrical in shape, with axis X. It incorporates a percussion rod type firing pin 14 at one end intended to ensure the percussion of the ammunition, and a limit stop 18 at the other end enabling the compression of the spring 5 during the displacement of the firing pin. It also incorporates a drive finger 3 cooperating with the groove 21 in the arming lever 2 and an immobilizing finger 13 intended to cooperate with the sear 8. The firing pin body 4 is arranged in a sleeve (not shown) which holds it in place and enables it to translate along axis X. Thus, when the arming lever 2 is in rotation, the drive finger 3 is displaced along the groove 21 and only transmits to the firing pin body 4 the component along axis X of the displacement of the arming lever 2, thereby transforming the rotation of the lever 2 into the translation of the firing pin body 4.

The spring 5 is positioned along axis X of the firing pin body 4 between the firing pin limit stop 18 and a support (not shown) for the spring integral with the breech.

The sear 8 (more particularly illustrated in FIG. 3) is substantially in the form of a polyhedron. It incorporates a face 15 to immobilize the firing pin (shown in FIG. 2), substantially orthogonal to the axis of displacement X of the firing pin body 4, and a bearing face 17 for the actuator, substantially orthogonal to the face 15 to immobilize the firing pin. The sear 8 is linked to the breech by means of a pin 32 making a pivot link between the sear 8 and the breech. The pin 32 is substantially parallel to the axis of displacement X of the firing pin body 4.

The sear 8 also incorporates a beveled face 30, arranged such that it forms an angle of approximately 45° with the axis of displacement X of the firing pin body 4, enabling a stress along axis X to be transformed into an orthogonal stress and thereby making the sear 8 revolve around its pin 32.

The actuator 6 is classically in the form of a motor body (for example, and electric or pneumatic jack) fitted with a rod 7 able to translate and transmit a stress to the sear 8. The rod 7 presses on bearing face 17 of the sear enabling a stress to be applied to the sear 8 so as to make it pivot around its pin 32. For example, an electromagnet will be used by way of an actuator 6, the coil of this electromagnet enabling a hub to be displaced onto which the rod 7 of the actuator will be joined.

The tappet 10 is arranged in opposition to the actuator 6. It is subjected to the action of a spring 9 and provides a constant stress on the sear 8 in an opposing direction to that of the rod 7.

Figure 4:
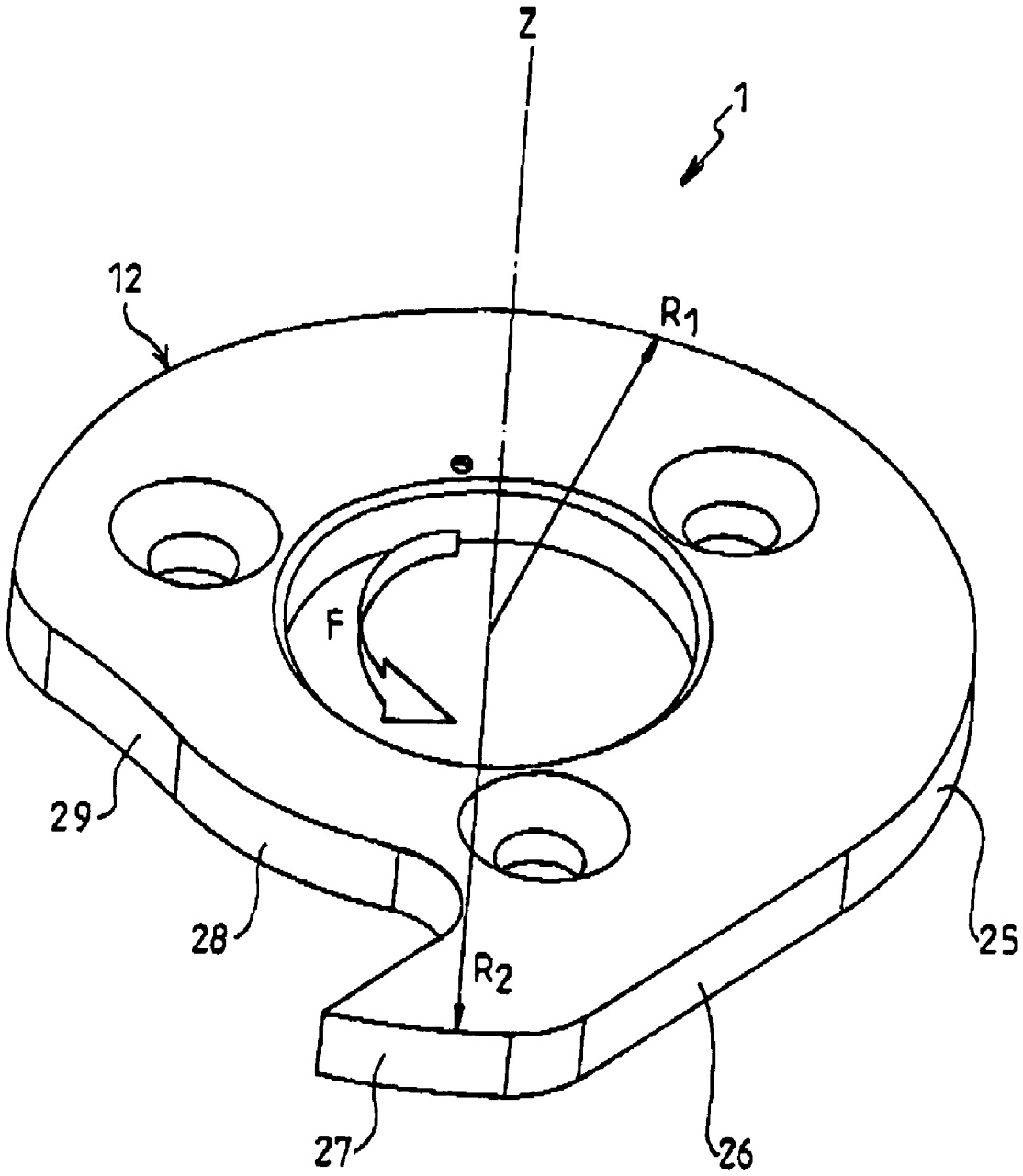
FIG. 4 shows an embodiment of the cam.

FIG. 4 shows the cam 1 making a rotational movement around rotational axis Z in direction F thanks to motor means (not shown). The cam 1 is already known and its geometry is defined by the weapon into which the invention is integrated. In this embodiment, the cam 1 incorporates a lateral rolling surface 1 for the roller 11 on which different zones are organized: a so-called "low dead centre" zone 25 with constant radius R1; a so-called "spring compression" zone 26 whose distance from axis Z increases following F; a so-called "high dead centre" 27 with constant radius R2 greater than R1; a "dog-tooth" zone followed by a so-called "percussion" zone 28 and a "firing pin withdrawal" zone 29. The cam 1 is integrated in the kinematics of the weapon system and makes one revolution per weapon cycle.

Figure 3:
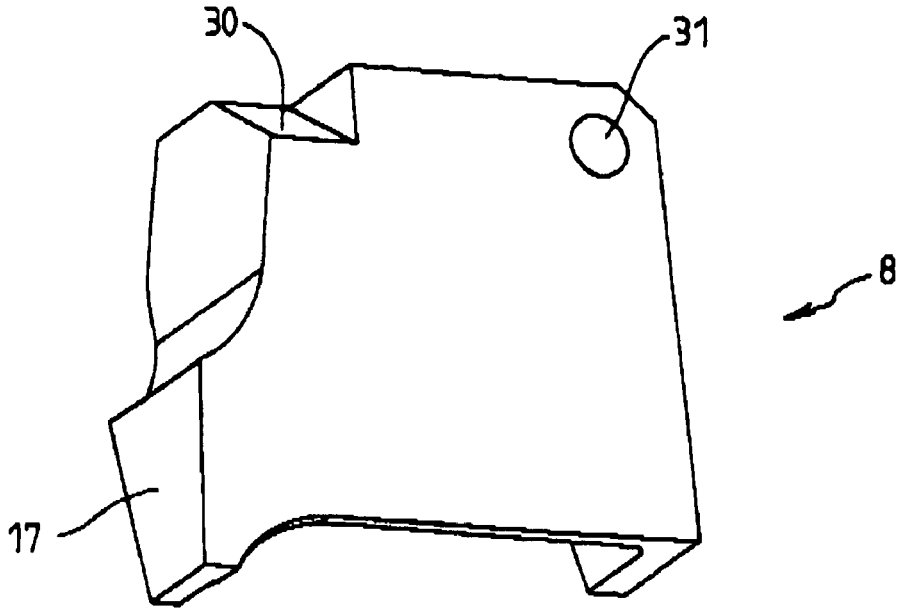
FIG. 3 shows an embodiment of the sear.

FIG. 3 shows an embodiment of the sear 8. In this illustration, the sear 8 can be seen to incorporate a bore hole 31 providing a passage for pin 32.

Figure 5:
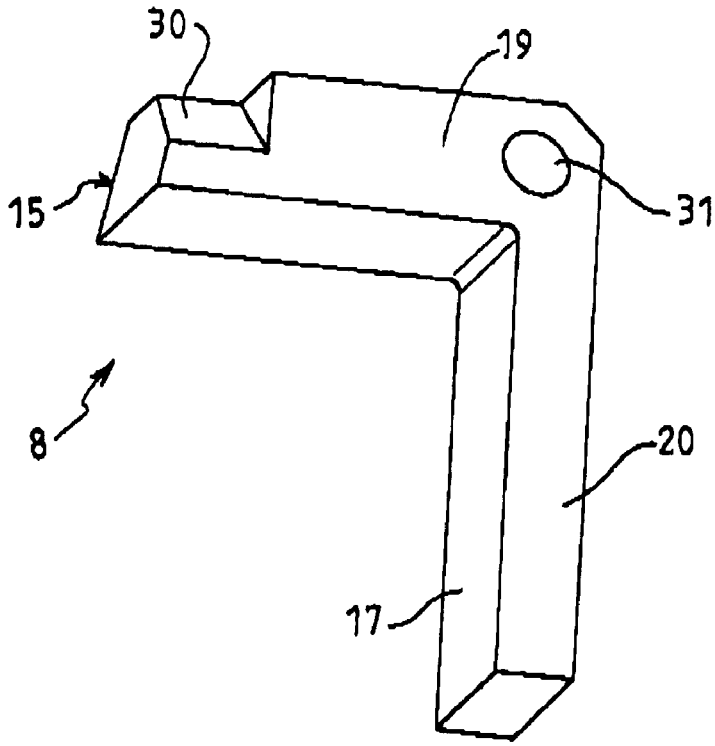
FIG. 5 shows a variant embodiment of the sear.

FIG. 5 illustrates a variant embodiment of the sear 8. In this variant, the sear 8 is L-shaped, a first branch 19 of the L, arranged orthogonally to the firing pin 4, incorporates a face 15 to immobilize the firing pin and ensures that the firing pin 4 is immobilized in its "armed" position, and a second branch 20, substantially perpendicular to the first one and to the actuator 6, incorporates a bearing face 17 subjected to the action of the actuator 6. A bore hole 31 with an axis orthogonal to the face 15 provides a passage for a pivot.

The device according to the invention functions as follows:

The firing cycle is initiated by means of a first "firing cycle" command (for example, when the firer presses on a firing button). As soon as the firing cycle is engaged, the cam 1 is made to revolve following arrow F. The profile of the lateral rolling surface 12 of the cam 1 is defined so as to ensure the rotation of the arming lever 2 by means of the roller 11 when the weapon's firing cycle is engaged. Thus, the circular movement of the cam 1 is transformed into a rotational movement of the arming lever 2. The law of movement of the arming lever thus depends on the manufacturing profile of the cam 1 which in turn depends on the kinematics of the weapon concept intended to receive the invention. Someone skilled in the art can define this profile in a known manner for the weapon in question.

While the cam 1 is revolving, the roller 11 rolls on the lateral rolling surface 12. When the roller rolls on the low dead centre 25, the raceway is circular, there is thus no movement of the arming lever 2.

When the roller 11 reaches the spring 5 compression zone 26, the geometry of the raceway tends to distance the roller 11 from the rotational axis X of the cam, thereby driving the arming lever 2 in rotation. The groove 21 in the arming lever 2 acts as a bearing point for the drive finger 3 of the firing pin. Thus, the movement of the arming lever 2 is transformed into a rectilinear translational movement of the firing pin 4. The translation of the firing pin 4 causes the compression of the percussion spring 5. The finger 13 of the firing pin 4 then presses against the beveled face 30, thereby causing the sear 8 to revolve around its axis 3 and to retract, allowing the firing pin 4 to pass.

At the end of the displacement of the firing pin, the finger 13 of the firing pin 4 is no longer pressing on the beveled face 30 of the sear 8 which, under the action of the tappet 10 and its spring 9, is returned to the locked position. The roller 11 then reaches the "high dead centre" zone 27 at which the raceway is circular. There is thus no movement of the arming lever 2 and no further translation of the fining pin 4. The firing pin 4 is locked in position. The cam continues to revolve until it reaches its starting position. When the roller 11 has passed through the "high dead centre" zone 27, it finds itself in the "percussion" zone 28, the percussion of the ammunition is thus now possible and firing may be triggered by means of a second "percussion" command (this command being able to be supplied automatically, for example, after a time which allows for the dissipation of any vibration generated by loading the ammunition, or by a calculator verifying the coincidence between laying the weapon and the line of sight). The ammunition is pushed into position at the same time as the firing pin 4 is moved into its "armed" position by the compression of the spring means 5.

Firing is triggered by means of the "percussion" command; the roller 11 then rolls on the "percussion" zone 28 enabling the reversal of the firing pin. Simultaneously, the coil of the electromagnet 6 is activated and the rod 7 of the hub of the electromagnet 6 acts on the sear 8 thereby unlocking the firing pin 4 held by its finger 3. The firing pin 4 is thereafter only subjected to the action of the spring 5 which expands to propel the firing pin 4 towards the ammunition. The percussion of the primer is effective.

As soon as the electromagnet's coil is deactivated, the tappet spring 9 pushes the tappet 10 and causes the sear 8 to revolve. At the same time, it also pushes the hub of the of the actuator's 6 electromagnet by acting, via the sear 8, on the rod 7.

The roller 11 thereafter reaches the "firing pin withdrawal" zone 29 and the device is effectively returned to its starting position and a second firing cycle may commence.

Figure 6:
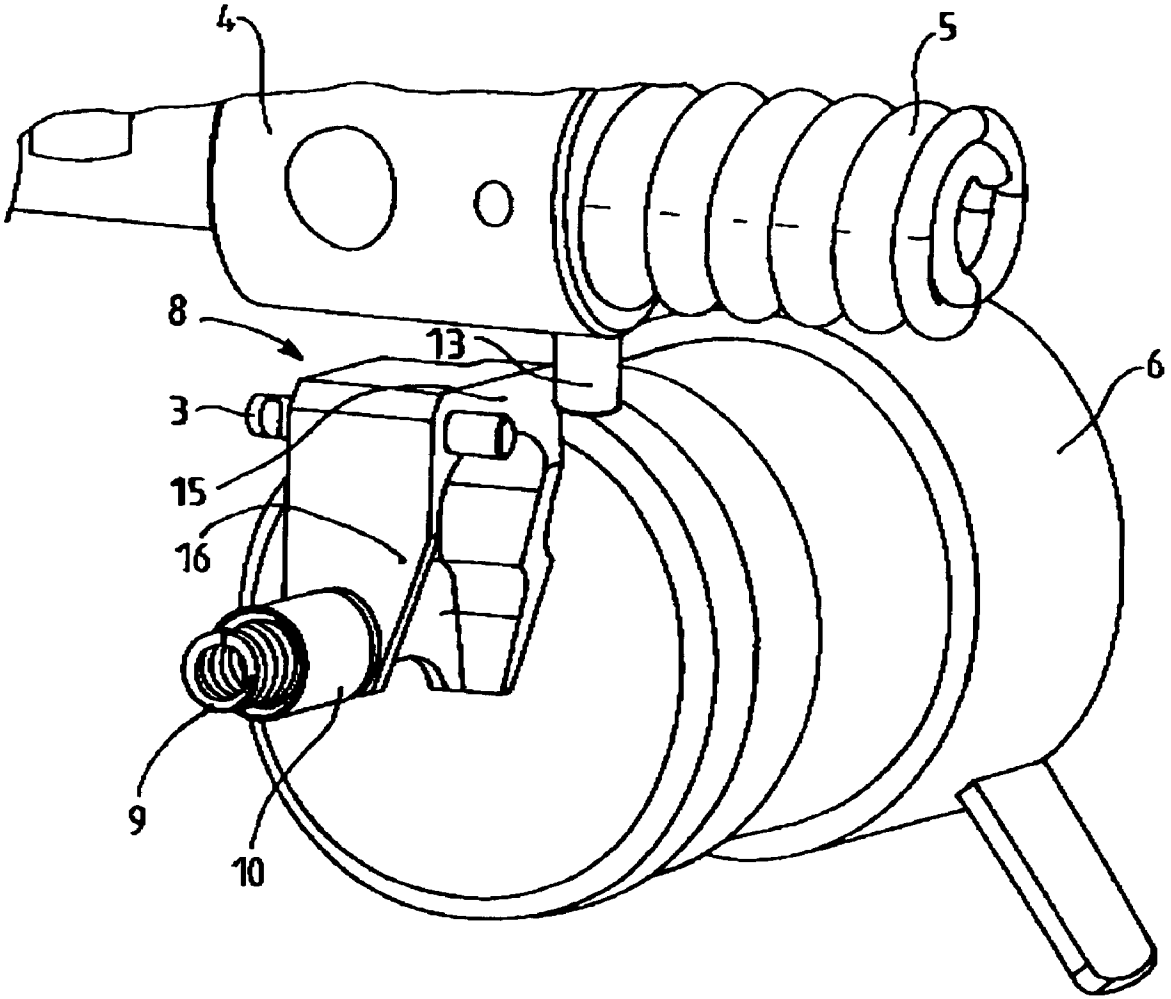
FIG. 6 shows the immobilizing of the firing pin in its "armed" position.

FIG. 6 illustrates the immobilization of the firing pin in its "armed" position. In this Figure, the immobilizing finger 13 can be seen to be pressing on the immobilizing face 15 of the sear 8. This immobilizing face of the firing pin is substantially orthogonal to the axis of displacement of the firing pin 4 (and thus to the stress due to the compression of the spring 5) which enables the stresses of the spring 5 to be withstood and the firing pin 4 to be immobilized.

In a specific embodiment, the invention incorporates position sensors so that the position of the cam can be known. Thus, the computer can deliver the "percussion" command only when the "percussion" command is delivered when the cam is in the percussion zone, which is to say when the roller 11 has passed through the "high dead centre" zone 27.

Preferentially, elements will be used which are able to be activated manually in the event of a failure or the destruction of the vehicle's power source.

Thus, the device according to the invention enables two modes of operation: a "classical" mode of operation, and an "optimized" mode of operation. The "optimized" mode of operation is that which has been described previously, and consists in performing the percussion in two stages: a first stage in which the ammunition is pushed into position and the spring is compressed, and a second stage in which the firing pin is release following a "percussion" command. This mode of operation advantageously enables precision fire which will not be disturbed by the vibrations due to the positioning of the ammunition, or distorted by an overlong wait between the validation of the fire and the actual percussion. The "classical" mode of operation is that which is currently used by weapons which are not equipped with a device according to the invention, in which the firing pin is never immobilized (for example, the electromagnet 6 is constantly activated) and the percussion is triggered by the passage of the roller 11 through the "high dead centre" zone 27. This mode of operation is less precise but enables a high rate of fire and is adapted to close-range firing. The gunner may thus choose the mode of operation which is best suited to the target to be reached.

We note that the law of movement of the cam 1 is specific to the kinematics of the weapon in which the invention is integrated but respects certain general principles such as the withdrawal of the firing pin (zone 29) after the firing phase (zone 28), the absence of stressing on the spring for the majority of the firing cycle, then the compression of the spring when the chamber (zone 26) is being closed and the release of the firing pin enabled as soon as the chamber is closed (end of zone 27).

What is claimed is:

1. A percussion device for a medium or large calibre weapon, and for support by the breech of such a weapon, said device comprising:

a firing pin body housing a firing pin and a spring for driving said firing pin in firing axial translation;

a drive cam for displacing said firing pin in the opposite axial translation direction and loading said spring thereby placing said firing pin in an armed position;

a sear for immobilizing the firing pin in an armed position, said sear being movable from a safety position wherein the sear immobilizes the firing pin in its armed position, to a firing position wherein the sear can release the firing pin for firing translation;

an electromagnetic actuator for displacing the sear thereby releasing the firing pin for firing translation;

a spring-loaded tappet for exerting force on the sear in a direction opposite to that of the actuator;

an arming lever, one end of which is mounted for rotation about an arming axis spaced from and orthogonal to the axis of firing translation of the firing pin;

a cam follower mounted for rotation about the arming axis and connected to the arming lever;

the drive cam mounted for rotation about a third axis parallel to the arming axis and spaced therefrom so that the cam follower abuts the drive cam, whereby rotation of the drive cam will cause rotation of the cam follower and the arming lever;

a second end of said arming lever contacting a drive finger on the firing pin body for moving the firing pin in axial translation thereby loading the firing pin spring and placing the firing pin in armed position.

2. A percussion device according to claim 1, wherein said sear comprises an immobilizing face, substantially orthogonal to the axis of displacement of said firing pin for ensuring immobilization of said firing pin in the armed position, and a bearing face for said actuator, substantially orthogonal to said immobilizing face of said firing pin and to the axis of displacement of said actuator, said bearing face for being subjected to the action of said actuator.

3. A percussion device according to claim 2, wherein said sear is L-shaped, a first branch of which, positioned orthogonally to said firing pin, is for ensuring immobilization of said firing pin in the armed position, and a second branch, substantially perpendicular to the first branch and to said actuator, is for being subjected to the action of said actuator.

4. A percussion device according to claim 3, wherein said sear is supported by a pivot having a hinge pin orthogonal to said immobilizing face of said firing pin.

5. A percussion device according to claim 2, wherein said sear is supported by a pivot having a hinge pin orthogonal to said immobilizing face of said firing pin.

6. A percussion device according to claim 5, wherein said sear comprises a beveled face onto which said firing pin presses when being moved into its armed position thereby pivoting said sear around said pivot.

7. A firing process for a piece of ammunition that includes a percussion device according to claim 1, comprising: triggering rotation of the drive cam by a first firing cycle command to drive said firing pin in translation to its armed position and to compress the spring; immobilizing the firing pin by said sear and by a second percussion command; the triggering displacement of the sear to release the firing pin which, under the action of the spring, is displaced in translation and strikes an ammunition thereby firing it.

8. The firing process for a piece of ammunition according to claim 7, wherein said percussion device includes position sensors for the drive cam, and the percussion command is delivered only when said drive cam is in a percussion zone.

9. The firing process for a piece of ammunition according to claim 8, wherein movement of the firing pin into the armed position and compression of the spring are performed simultaneously when said ammunition is pushed into position.

* * * * *